United States Patent [19]

Gora et al.

[11] Patent Number: 4,646,704

[45] Date of Patent: Mar. 3, 1987

[54] PRESSURE WAVE SUPERCHARGER WITH VIBRATION DAMPED ROTOR

[75] Inventors: Hans-Joachim Gora; Bernhard Lange, both of Russelsheim, Fed. Rep. of Germany

[73] Assignee: General Motors Corporation, Detroit, Mich.

[21] Appl. No.: 819,384

[22] Filed: Jan. 16, 1986

[30] Foreign Application Priority Data

Jan. 30, 1985 [DE] Fed. Rep. of Germany ..... 3503071

[51] Int. Cl.[4] ..... F02B 33/00

[52] U.S. Cl. ..... 123/559; 60/39.45; 417/64

[58] Field of Search ..... 60/39.45 A, 39.45 R; 74/574; 123/559 A; 417/64; 464/180

[56] References Cited

U.S. PATENT DOCUMENTS 3,052,107 9/1962 Kempf ..... 464/180

4,269,570 5/1981 Rao ..... 417/64

*Primary Examiner*—Stephen F. Husar

*Attorney, Agent, or Firm*—Robert J. Outland

[57] ABSTRACT

A pressure wave supercharger for internal combustion engines, particularly those in motor vehicles, has a rotor, driven in proportion to the engine speed, with a plurality of rotor cells oriented parallel to its axis of rotation. The cells are connected, at one end, in the exhaust gas flow between the exhaust manifold and the exhaust system and, at the other end, in the intake air stream between the air intake and the intake manifold. Placed on the rotor and concentric therewith is a rigid vibration damping ring, which is contacted by a support, firmly attached to the rotor, so as to create friction. The friction produced by sliding of the rigid ring on the support, acts to absorb a large part of the vibration energy of the rotor and thereby, correspondingly, to eliminate the production of annoying noise.

7 Claims, 4 Drawing Figures

Fig.1
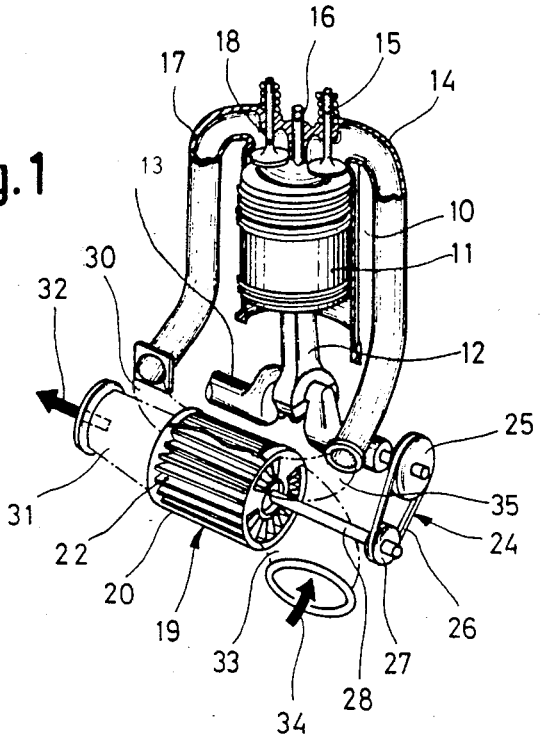
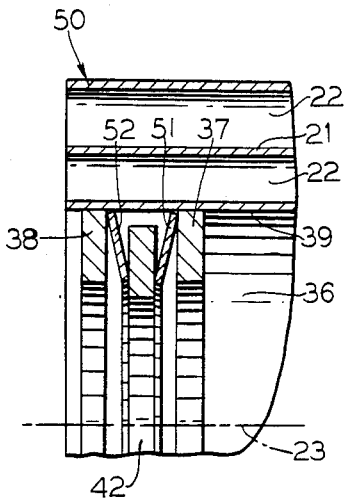
Fig.4
Fig.2
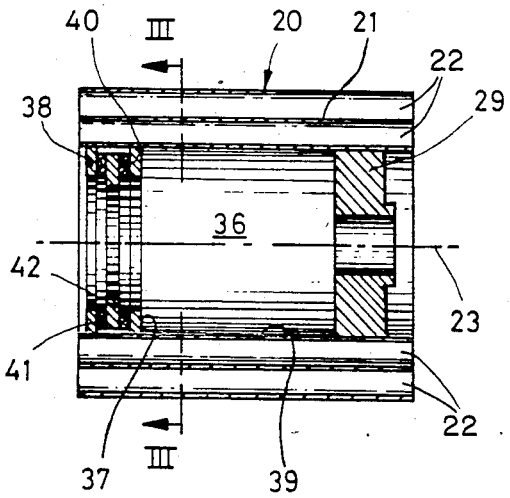
Fig.3
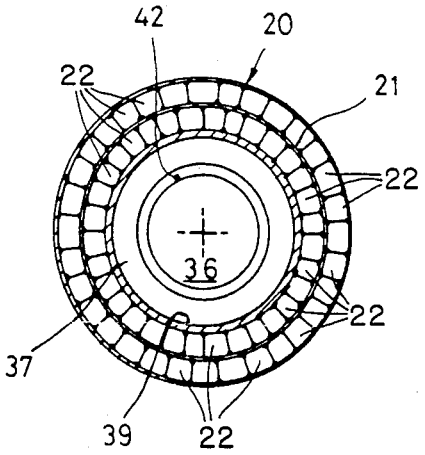

PRESSURE WAVE SUPERCHARGER WITH VIBRATION DAMPED ROTOR

This invention pertains to pressure wave superchargers for use with internal combustion engines, especially in motor vehicles. In particular the invention pertains to superchargers of a type having a rotor driven proportionally to engine speed and including a plurality of rotor cells arranged parallel to its axis of rotation which are connected at one end, in the stream of exhaust gases between the exhaust manifold and the exhaust system and, at the other end, in the combustion-air flow between the air intake and the intake manifold.

Pressure wave superchargers of the type described have been disclosed, for example, in an updated leaflet of the BBC Brown Boveri Company entitled "Performance+Economy: Comprex Supercharging". Such pressure wave superchargers transmit energy directly from the exhaust to the intake air and therefore operate with very little lag. In an engine supercharged with a pressure wave supercharger, torque therefore develops about as rapidly as in a normally aspirated engine. Because of the immediate availability of increased torque, pressure wave superchargers are increasingly being used in diesel vehicles.

Devices used as pressure wave supercharges are subject to severe stresses from high temperatures and rotational speeds.

At high engine speeds with correspondingly higher rotation rates for the pressure wave supercharger rotor, it has been noted that the rotor can be caused to vibrate because of gas impacts. Because of its construction and mounting, the supercharger rotor has an extended natural resonance (structural vibration). Its natural vibrations are excited by gas forces over a broad range, i.e., over a wide frequency range (ca. 3–15 kHz). One essential cause of this is the uneven distribution of chambers on the rotor. In practice, therefore, the natural resonance of the rotor is excited at all engine and rotor speeds. Therefore, the rotor deforms, e.g., its periphery becomes elliptical and changes laterally in step with the vibrations. Acoustically, these vibrations are characterized by a clearly audible howling sound, which is perceived by the vehicle user.

The purpose of the invention is to damp the vibrations which occur in the manner referred to and thereby to eliminate or at least to reduce the howling noise.

According to the invention, this purpose is fulfilled by a pressure wave supercharger of the type mentioned above, in which a rigid ring is carried solely on the rotor concentrically therewith and is subject to friction from a support firmly joined to the rotor.

It is advantageous if the support consists of two support discs arranged on either side of the ring and supporting the latter axially between them, and if, in order to create the friction effect, friction elements are inserted between the support discs and the end surfaces of the ring next to each of them. These friction elements can be designed as annular friction linings, or as spring means, e.g. disc springs.

The provisions according to the invention produce the advantageous result that the above-mentioned vibrations are largely absorbed by the relative motions which occur, accompanied by friction between the rotor and the rigid ring joined by the latter by the friction linings with the result that the annoying noise is also correspondingly eliminated or reduced.

Further advantageous implementations of the invention may also be provided.

The invention will be described in more detail below based on one example of an embodiment and with reference to the drawing in which:

FIG. 1 shows a perspective view of a pressure wave supercharger, together with parts of an internal combustion engine (schematic), FIG. 2 shows - also schematically - a pressure wave supercharger corresponding to FIG. 1 in longitudinal section (drive elements omitted), FIG. 3 shows a section along line III—III in FIG. 2, and FIG. 4 is an enlarged fragmentary cross section similar to FIG. 2 but showing an alternative embodiment.

In FIG. 1, numeral 10 denotes a cylinder, 11 a piston, 12 a connecting rod and 13 the crankshaft of an internal-combustion engine. Air required for combustion is conveyed to the combustion chamber located above the piston 11 through an intake air manifold represented by pipe 14 and is admitted into the combustion chamber under the control of an intake valve 15. Fuel is introduced by means of an injector system, whose injector nozzle is schematically shown in FIG. 1 and designated 16. Exhaust gases are removed following combustion through an exhaust manifold represented by pipe 17, the exhaust flow being controlled by an exhaust valve 18.

A so-called pressure wave supercharger, overall designation 19, is provided in order to transfer a portion of the energy remaining in the exhaust gases to the incoming air charge. An essential part of the pressure wave supercharger 19 is a rotor 20 (cf. also FIG. 2), which is annular in shape and has an annular outer housing ring 21 defining a plurality of rotor cells 22. As shown in FIG. 1, the cells 22 are oriented parallel to the axis of rotation 23 (FIG. 2) of the rotor 20.

As may again be inferred from FIG. 1, the rotor 20 is driven by the crankshaft 13 through a belt drive 24 at a speed proportional to and greater than the engine speed. For this purpose, the crankshaft is fitted with a drive pulley 25 which is operationally connected through a drive belt 26 with a driven pulley 27. The driven pulley 27 is fixed onto a rotor drive shaft 28. The rotor drive shaft also serves to mount the rotor 20 within the engine housing (not shown). In FIG. 2, the hub of the rotor 20 is shown inserted into its inner bore 39 and designated 29. The drive shaft 28 has been omitted from the illustration in FIG. 2.

As already mentioned, the pressure wave supercharger 19 uses the energy of the exhaust gases to compress the outside air conveyed to the combustion chamber through the intake air manifold or pipe 14. For this purpose, the engine exhaust coming from the exhaust manifold or pipe 17 flows through a gas conduit 30 to the rotor 20, gives up energy to the air in the cells 22 of the rotor 20 by means of pressure waves and then passes through an exhaust pipe outlet 31 in the direction of the arrow 32 into the engine exhaust system (not shown). In an air conduit 33, also connected with the cells 22 of the rotor 20, fresh air is sucked in (direction of arrow 34) during rotation of the rotor 20 during the pressure wave cycle, compressed and forced through an air outlet 35 into the intake air pipe 14, whence the outside air—as described above—reaches the engine combustion chamber.

In order to prevent the rotor 20 from vibrating at high frequencies in the audible range as a result of its relatively high rotational speed, determined by engine as speed multiplied by the belt drive 24 (cf. FIG. 1), a vibration damping system is provided, as shown in detail in FIG. 2. For this purpose, two annular bearing or support discs 37, 38 are placed at a distance from one another in a cylindrical inner chamber 36 of the rotor forming the radial inner limit of the annular rotor housing 21. The support discs 37, 38 are attached to the inner surface 39 of the annular housing 21. Placed between the two support discs 37, 38 are two annular friction linings 40, 41, which enclose between them a metal ring 42. The metal ring 42 should be constructed as rigidly as possible and should be held against the friction linings 40, 41 by the two support discs 37, 38 so as to create friction. FIG. 2 illustrates that the outer diameter of the rigid metal ring 42 approximately corresponds to the inner diameter of the cylindrical inner chamber 36 of the rotor by which it is solely carried. FIG. 2 additionally indicates that the vibration damping system 37, 38, 40, 42 is placed at the left hand end of the rotor 20, i.e. at the end opposite the hub 29 of the rotor 20.

The vibration damping system operates as follows: as the rotational speed of the rotor 20 changes, slight relative movements occur in the direction of rotation between the latter and the rigid metal ring 42, so that friction occurs between the metal ring 42 and the friction linings 40, 41. The friction largely absorbs the vibrational energy of the rotor 20, so that the noise associated with the vibrations is practically eliminated. The same effect is also obtained for deformation of the rotor caused by resonance type natural vibrations, i.e., those involving radial expansion or contraction. In this case as well, the desired friction occurs between the metal ring 42 and the friction linings 40, 41 against the two bearing discs 37, 38 which vibrate together with the rotor 20, so that the corresponding noise is damped out.

FIG. 4 shows an alternative embodiment of damped rotor 50 that is generally similar to rotor 20 of FIG. 2 and wherein like numerals indicate like parts. The damping system of rotor 50 differs from that of rotor 20 in that disc springs 51, 52 are substituted for the friction linings 40, 41 respectively of the FIG. 2 embodiment. Springs 51, 52 bear against their respective bearing discs 37, 38 and engage the metal damping ring 42 to create friction for damping out vibration of the rotor in the same manner as do the friction linings of the FIG. 2 embodiment.

The embodiments of the invention in which an exclusive property or privilege is claimed are defined as follows:

1. A pressure wave supercharger for internal combustion engines and having a rotor which is driven in proportion to engine speed and has a plurality of rotor cells directed parallel to its axis of rotation and connected on one end in the engine exhaust stream and on the other end in the engine combustion air stream, wherein there is carried, solely on the rotor and concentrically thereto, a rigid damping ring which is connected through friction means to a support fixed to the rotor.

2. A pressure wave supercharger according to claim 1, wherein the support comprises two bearing discs disposed one on either side of the ring and holding the latter axially therebetween, and the friction means comprise friction elements interposed between the bearing discs and respectively associated faces of the ring.

3. A pressure wave supercharger according to claim 2, wherein the friction elements comprise annular friction linings.

4. A pressure wave supercharger according to claim 2, wherein spring means act as the friction elements.

5. A pressure wave supercharger according to claim 2, wherein the ring is disposed inside a cylindrical rotor inner chamber forming the inner radial boundary of the rotor cells, and the outside diameter of the ring corresponds approximately to the inside diameter of the cylindrical rotor inner chamber.

6. A pressure wave supercharger according to claim 5, wherein the support is attached to a tubular wall of the cylindrical rotor inner chamber.

7. A pressure wave supercharger according to claim 5, wherein means for driving the rotor are provided at one end of the cylindrical rotor inner chamber and the ring support and friction elements are disposed at the other end of the cylindrical rotor inner chamber.

* * * * *